United States Patent [19]

Watanabe

[11] Patent Number: 4,541,148

[45] Date of Patent: Sep. 17, 1985

[54] TILTABLE TACK BUTTON

[75] Inventor: Hirokazu Watanabe, Kurobe, Japan

[73] Assignee: Nippon Notion Kogyo Co., Ltd., Tokyo, Japan

[21] Appl. No.: 580,741

[22] Filed: Feb. 16, 1984

[30] Foreign Application Priority Data

Feb. 18, 1983 [JP] Japan ..... 58-22666[U]

[51] Int. Cl.[4] ..... A44B 1/38

[52] U.S. Cl. ..... 24/108; 24/90 R; 24/92; 24/102 PL

[58] Field of Search ..... 24/108, 107, 90 R, 92, 24/98, 102 A, 102 E, 102 SL, 102 PL, 689, 93, 94

[56] References Cited

U.S. PATENT DOCUMENTS

| | | | |
|---|---|---|---|
| 878,683 | 2/1908 | Stashko | 24/108 |
| 2,014,814 | 9/1935 | Reiter | 24/108 |
| 2,835,948 | 5/1958 | Blake | 24/108 |
| 3,141,211 | 7/1964 | Blake | 24/90 R |
| 4,387,488 | 6/1983 | Kanzaka | 24/92 |
| 4,457,050 | 7/1984 | Kanzaka | 24/108 |

FOREIGN PATENT DOCUMENTS

| | | | |
|---|---|---|---|
| 54-4640 | 1/1979 | Japan . | |
| 325430 | 2/1930 | United Kingdom | 24/102 PL |

*Primary Examiner*—Victor N. Sakran

*Attorney, Agent, or Firm*—Hill, Van Santen, Steadman & Simpson

[57] ABSTRACT

A button has a unitary interior member of thermoplastic synthetic resin. The interior member includes a disk-like portion non-rotatably held between a cap and a button back, a socket portion joined with a tack member with a garment fabric sandwiched therebetween, and a resilient connecting portion in the form of a pair of elongate planar webs extending between the disk-like portion and the socket portion and normally urging the disk-like portion to lie perpendicular to the socket portion. The connecting portion is bendable so that the disk-like portion and thus the button body can be manually tilted with respect to the axis of the socket portion and thus the garment fabric.

1 Claim, 6 Drawing Figures

TILTABLE TACK BUTTON

BACKGROUND OF THE INVENTION

1. Field of the Invention

The present invention relates to a button including a button body and a tack member adapted to be joined with the button body for attachment of the button to a garment fabric.

2. Prior Art

Various buttons are known which generally comprise a button body and a tack member adapted to be joined with the button body for attachment of the button to a garment fabric. In attachment, a tapering end of the tack member's shank is pierced through a garment fabric and then forced into a hollow hub of the button body so as to deform the tapering end of the shank, thus securing the latter to the hollow hub of the button body. Since a head of the button body is not tiltable with respect to the hollow hub and thus the garment fabric, the button body must be tilted together with a portion of the garment fabric therearound as the button is threaded through and removed from a button hole in the garment. Consequently, this prior button is not suitable for a garment of denim, which is thick and very less flexible.

Japanese Patent Publication (Kokoku) No. 54-4640 discloses a button in which a head of a button body has a spherical projection pivotably received in a fixed hollow hub; the head is tiltable with respect to the hollow hub and thus a garment fabric. However, because the head tends to be rotated or angularly moved on its own axis, this prior button cannot be used if the head bears on its face a design or emblem indicative of a direction in which the head must be oriented.

SUMMARY OF THE INVENTION

According to the present invention, a button has a unitary interior member of thermoplastic synthetic resin. The interior member includes a disk-like portion non-rotatably held between the cap and the button back, a socket portion joined with the tack member with the garment fabric sandwiched therebetween, and a resilient connecting portion in the form of a pair of elongate planar webs extending between the disk-like portion and the socket portion and normally urging the disk-like portion to lie perpendicular to the socket portion. The connecting portion is bendable so that the disk-like portion and thus the button body can be manually tilted with respect to the axis of the socket portion and thus the garment fabric.

It is therefore an object of the invention to provide a button in which a button body can be manually tilted with respect to a tack member's shank and thus a garment fabric without being rotated or angularly moved on their own axes.

Another object of the invention is to provide a button suitable for a garment of denim which is thick and very less flexible, enabling the button body to tilt, irrespective of the garment fabric, for being threaded through and removed from a button hole in the garment with maximum ease.

Many other advantages, features and additional objects of the present invention will become manifest to those versed in the art upon making reference to the detailed description and the accompanying drawings in which a preferred structural embodiment incorporating the principles of the present inventions is shown by way of illustrative example.

DETAILED DESCRIPTION

Figure 1:
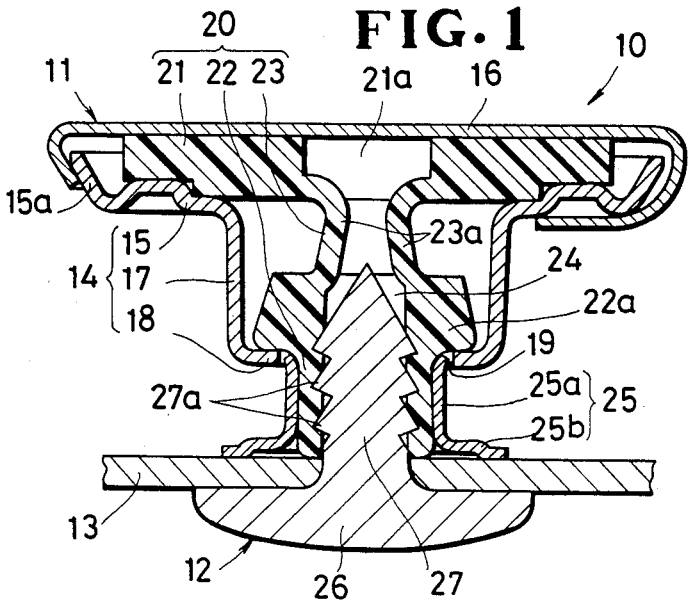
FIG. 1 is a vertical cross-sectional view of a button embodying the present invention, showing the same having been attached to a garment fabric.

The present invention is particularly useful when embodied in a button such as shown in FIG. 1, generally indicated by the numeral 10.

The button 10 generally comprises a button body 11 and a tack member 12 (joined with the button body 11 in a manner described below), attaching the button 10 to a garment fabric 13.

Figure 2:
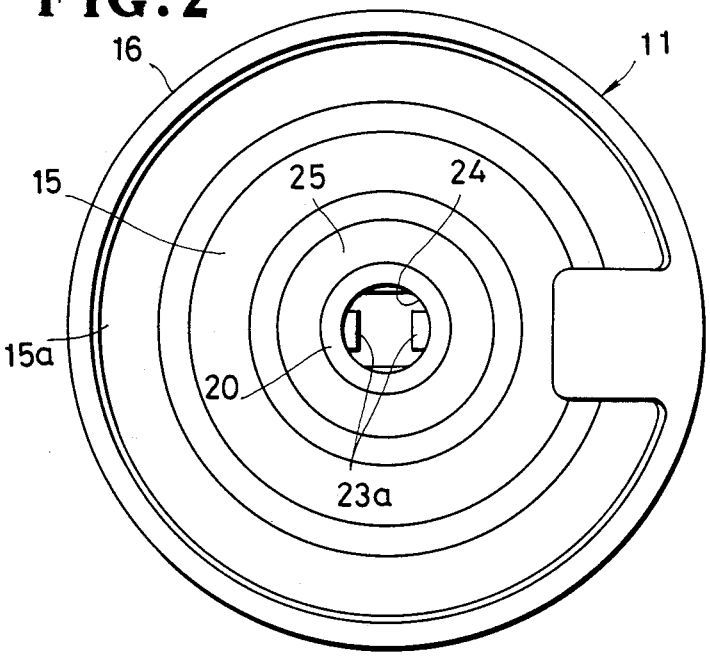
FIG. 2 is a bottom view of a button body.
Figure 3:
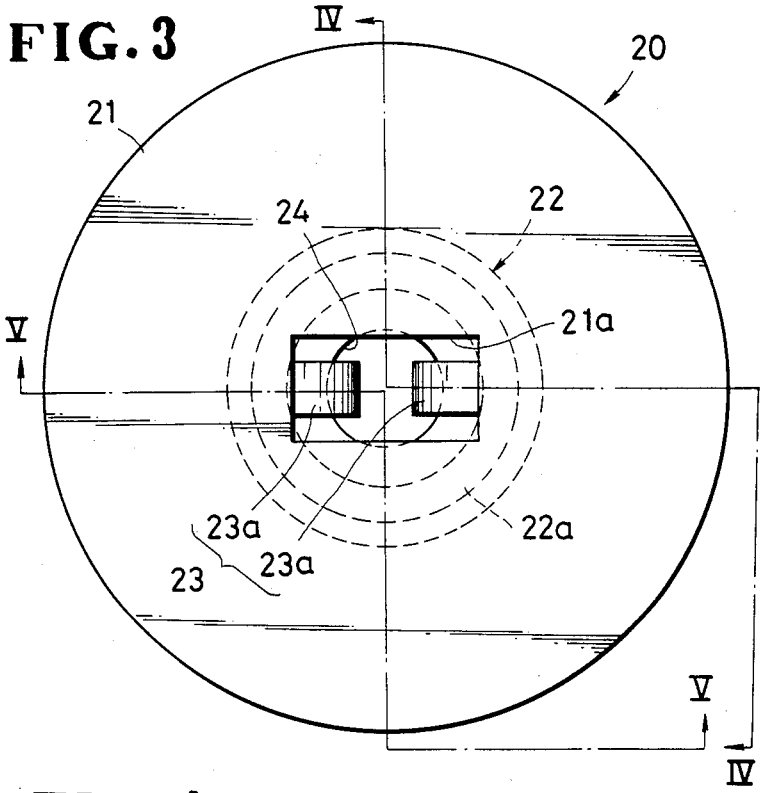
FIG. 3 is an enlarged plan view of an interior member.
Figure 4:
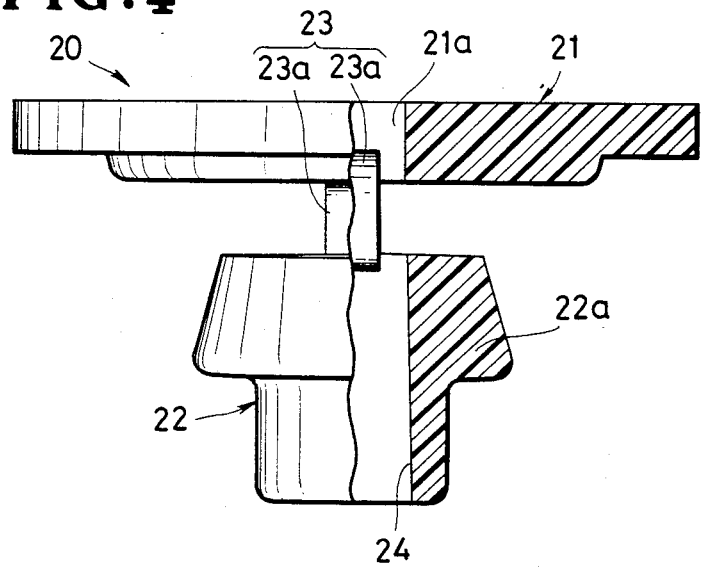
FIG. 4 is a cross-sectional view taken along line IV—IV of FIG. 3.
Figure 5:
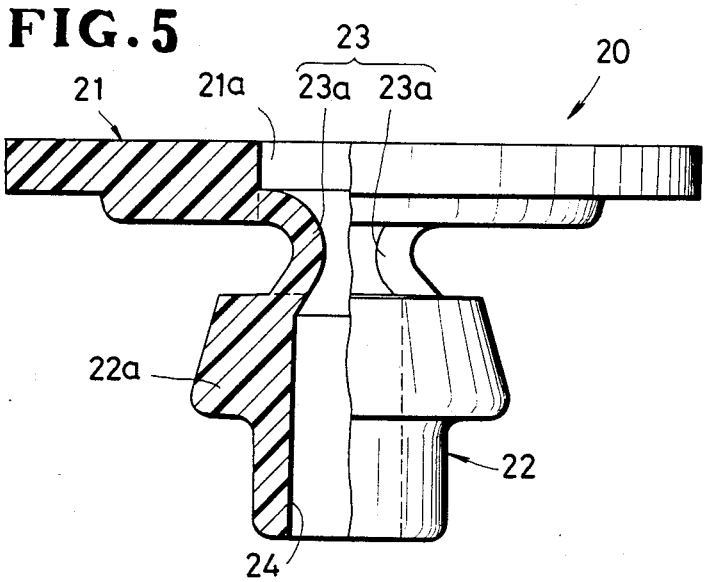
FIG. 5 is a cross-sectional view taken along line V—V of FIG. 3.

As shown in FIGS. 1 and 2, the button body 11 includes a button back 14 having an upper annular flange (hereinafter referred to as "first flange") 15 having an annular rim 15*a* covered by a cap 16. The button back 14 also has a hollow hub 17 of circular cross section projecting downwardly from an inner edge of the annular first flange 15 and terminating in an inwardly directed lower annular flange (hereinafter referred to as "second flange") 18 defining a central aperture 19. The button back 14 and the cap 16 are made of metal.

A unitary interior member 20 (FIGS. 1 to 6) of thermoplastic synthetic resin includes a disk-like portion 21 non-rotatably sandwiched between the cap 16 and the button back's second flange 18. A resilient connecting portion 23 is integral with and extends between the disk-like portion 21 and a socket portion 22, normally urging the disk-like portion 21 to lie peripendicular to the socket portion 22. The connecting portion 23 is in the form of a pair of elongate planar webs 23*a*, 23*a* disposed diametrically of an axial through-bore 24 of the socket portion 22 and of a central opening 21*a* of the disk-like portion 21. The socket portion 22 has a collar 22*a* loosely received in the hollow hub 17 of the button back 14 and normally urged against the button back's second flange 18 under the resilience of the connecting portion 23. The connecting portion 23 is bendable so that the disk-like portion 21 and thus the button body 11 can be manually tilted with respect to the axis of the socket portion 22, as described below in connection with FIG. 6.

An eyelet member 25 includes a tube 25*a* of metal non-rotatably mounted on the socket portion 22, covering a collar-free lower half of the socket portion 22. The tube 25*a* has at its lower end an outwardly directed flange (hereinafter referred to as "third flange") 25*b*.

Figure 6:
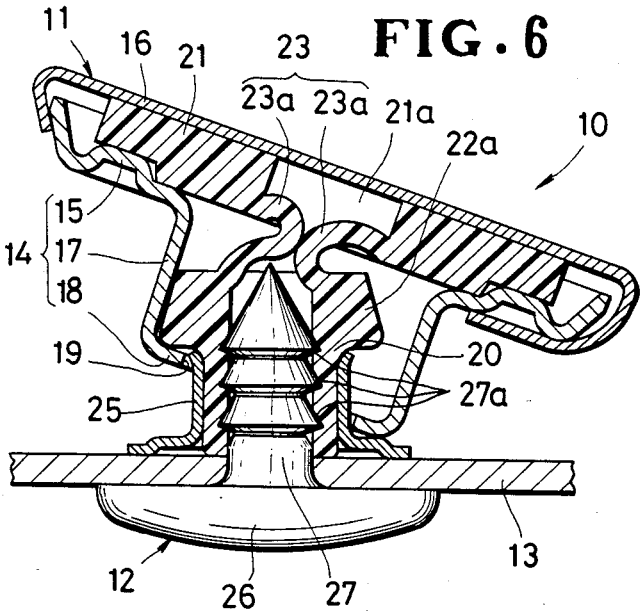
FIG. 6 is a cross-sectional view similar to FIG. 1, showing the button body having been tilted with respect to a socket portion of the interior member.

As shown in FIGS. 1 and 6, the tack member 12, which is preferably of metal, includes a head 26 and a shank 27 of circular cross section projecting perpendicularly and centrally from one face of the head 26. The shank 27 is pierced through the garment fabric 13 and is non-rotatably inserted into the axial through-bore 24 of the socket portion 22, the garment fabric 13 being sandwiched between the eyelet member's third flange 25*b* and the tack member's head 26. The shank 27 has a plurality of spaced annular ridges 27*a* and is thereby prevented from being removed from the socket portion 22. Thus the tack 12 is non-rotatably joined with the button body 11, attaching the button 10 to the garment fabric 13.

In FIG. 1, for instance, if the right edge portion of the button body 11 is pushed downwardly by hand, or if the left edge portion of the button body 11 is pulled upwardly by hand, the resilient connecting portion 23 is bent to allow the button body 11 and the interior member's disk-like portion 21 to assume an inclined position (FIG. 6) with respect to the axis of the socket portion 22 and thus the garment fabric 13.

During that time, both the button body 11 and the interior member's disk-like portion 21 are free from being rotated or angularly moved on their own axes, partly because the button body 11 and the eyelet member 25 are non-rotatably joined with the disk-like and socket portions 21, 22, respectively, of the interior member, and partly because the disk-like portion 21 and the socket portion 22 are interconnected by the pair of elongate planar webs 23*a*, 23*a* disposed diametrically of the socket portion's through-bore 24 and of the disk-like portion's center opening 21*a*.

In its inclined position, the button body 11 can be threaded through and removed from a button hole (not shown) in the garment with maximum ease.

In the absence of external force acting on any edge portion of the button body 11, the face of the button body 11 remains to be horizontal, i.e. parallel to the general plane of the garment fabric 13, under the resilience of the connecting portion 23, which is tidy.

Further, because the button body 11 and the cap 16 are non-rotatable on their own axes, the present invention is useful even if the button 10 bears on its face a design or emblem indicative of a direction in which the button 10 must be oriented.

Although various minor modifications may be suggested by those versed in the art, it should be understood that I wish to embody within the scope of the patent warranted hereon, all such embodiments as reasonably and properly come within the scope of my contribution to the art.

What is claimed is:

1. A button for attachment to a garment fabric, comprising:

(a) a button body including a button back and a cap covering said button back on its obverse side, said button back including a hollow hub disposed remotely from said cap and extending perpendicularly to and centrally of said cap, a first flange projecting outwardly from one end of said hollow hub, and a second flange projecting inwardly from the other end of said hollow hub to define a central aperture;

(b) an interior member of thermoplastic synthetic resin including a disk-like portion non-rotatably held between said cap and said first flange of said button back, a socket portion extending through said central aperture defined by said second flange of said button back, and a resilient connecting portion integral with said disk-like portion and said socket portion and extending between said disk-like portion and said socket portion and normally urging said disk-like portion to lie perpendicularly to said socket portion, said connecting portion comprising a pair of elongate planar webs disposed diametrically of said socket portion, said socket portion having a collar loosely received in said hollow hub and normally urged against said second flange of said button back under the resilience of said connecting portion, said socket portion also having an axial bore, said connecting portion being bendable so that said disk-like portion and thus said button body can be manually tilted with respect to the axis of said socket portion against the resilience of said connecting portion;

(c) an eyelet member non-rotatably mounted on said socket member at a collar-free side thereof; and (d) a tack member including a head and a shank projecting perpendicularly and centrally from said head for being pierced through the garment fabric and then inserted into said axial bore of said socket portion to thereby join said tack member with said button body.

* * * * *